US006875316B1

(12) United States Patent
Hanaoka et al.

(10) Patent No.: US 6,875,316 B1
(45) Date of Patent: Apr. 5, 2005

(54) HIGH REACTIVITY AND HIGH STRENGTH COKE FOR BLAST FURNACE AND METHOD FOR PRODUCING THE SAME

(75) Inventors: Koji Hanaoka, Okayama (JP); Seiji Sakamoto, Okayama (JP); Katsutoshi Igawa, Okayama (JP); Yutaka Yamauchi, Okayama (JP); Shizuki Kasaoka, Okayama (JP); Toshiro Sawada, Okayama (JP); Koichi Shinohara, Okayama (JP); Yuji Tsukihara, Okayama (JP); Shinjiro Baba, Okayama (JP)

(73) Assignee: JFE Steel Corporation (JP)

( * ) Notice: Subject to any disclaimer, the term of this patent is extended or adjusted under 35 U.S.C. 154(b) by 646 days.

(21) Appl. No.: 09/868,480

(22) PCT Filed: Oct. 19, 2000

(86) PCT No.: PCT/JP00/07269

§ 371 (c)(1),
(2), (4) Date: Jul. 13, 2001

(87) PCT Pub. No.: WO01/29151

PCT Pub. Date: Apr. 26, 2001

(30) Foreign Application Priority Data

Oct. 20, 1999 (JP) ..... 11-298609
Sep. 13, 2000 (JP) ..... 2000-278604

(51) Int. Cl.[7] ..... B01D 45/00; C10B 27/00
(52) U.S. Cl. ..... 201/4; 201/5; 201/6
(58) Field of Search ..... 201/4, 5, 6

(56) References Cited

U.S. PATENT DOCUMENTS 4,100,031 A * 7/1978 Kiritani et al. ..... 201/6
4,419,186 A * 12/1983 Wienert ..... 201/6

FOREIGN PATENT DOCUMENTS

JP 11021561 * 1/1999
JP 11241072 * 9/1999
JP 2001011472 * 1/2001

* cited by examiner

*Primary Examiner*—N. Bhat
(74) *Attorney, Agent, or Firm*—DLA Piper Rudnick Gray Cary US LLP

(57) ABSTRACT

Related to a blast furnace coke and a production method thereof. A coke having high reactivity and high strength in which coke strength, reactivity with $CO_2$ and a pore size distribution are each at a desired level can be produced at a low cost by using a coal blend composed of a small number of brands comprising a large quantity of caking coal having medium rank and low fluidity. The blast furnace coke, being obtained by charging a coal blend comprising 60 wt % or more of semi-heavy caking coal having medium rank and low fluidity in which a content of inert component is 30 vol % or more in total or another coal blend comprising 60 wt % to 95 wt % of semi-heavy caking coal having medium rank and low fluidity in which mean reflectance (Ro) is 0.9 to 1.1 and maximum fluidity (MF) is less than 3.0 and the balance being a caking coal in which mean reflectance (Ro) exceeds 1.1 into a coke oven and coking the coal blend, which has a pore size distribution where a content ratio of pores having a diameter of less than 10 $\mu$m is from 12 vol % to 15 vol % and a content ratio of pores having a diameter of from 10 $\mu$m to 100 $\mu$m is from 10 vol % to 15 vol % and the production method thereof.

10 Claims, 5 Drawing Sheets

SINGLE COKE OF COAL HAVING
MEDIUM RANK AND LOW FLUIDITY

ORDINARY COKE

HIGH REACTIVITY AND HIGH STRENGTH COKE FOR BLAST FURNACE AND METHOD FOR PRODUCING THE SAME

TECHNICAL FIELD

The present invention relates to blast furnace coke having high reactivity and high strength and a method of producing such blast furnace coke, and more particularly, to coke in which coke strength, reactivity with $CO_2$ and a pore size distribution are each at a desired level and a method of producing such coke.

BACKGROUND OF THE INVENTION

In recent years, in view of an aging problem of a coke oven, there is an attempt to prolong a service life of the coke oven by decreasing an operating rate thereof. For such attempt, an operation of a blast furnace has been conducted while an injection quantity of pulverized coals was increased.

However, an increase of the injection quantity of pulverized coals into the blast furnace bring about not only a decrease of coke ratio but also an increase of load to coke in the blast furnace derived from an increase of an ore to coke ratio whereupon such increase of load exceeds coke strength to promote degradation of coke. Such degradation of coke aggravates gas permeability in the blast furnace to effect operational abnormalities such as hanging, slip and the like of a burden which, in the end, remarkably deteriorate an operation of the blast furnace. For this reason, it is important to suppress degradation of coke as much as possible.

Meanwhile, the coke in the blast furnace reacts with carbon dioxide ($CO_2$) to be partially gasified whereupon the coke becomes porous effecting a decrease of strength thereof. As a method of suppressing such decrease of the strength thereof, a technique to reduce the reactivity with $CO_2$ has heretofore been under review; however, such technique causes an increase of energy cost of the blast furnace. Therefore, it is not advantageous from a standpoint of cost reduction and nowadays an operation with a low fuel ratio is rather required. In order to conduct such operation with a low fuel ratio, it is effective to pursue an increase of a reduction efficiency in the blast furnace by decreasing an operational temperature down to a temperature in a thermal reserve zone in a neighborhood of wustite-iron reduction equilibrium. For the reason described above, it is considered to use high reactive coke (CAMP-ISIJ, Vol. 5 (1992) 156).

Further, as a method of producing such high reactive coke, a method of increasing a ratio of non- to slight-caking coal in a material coal blend, a method of adding an inert coal material, that is, blending an inert substance as disclosed in Japanese Patent Laid-Open No. 313171/1994 and a method of blending char derived from a low carbonization coal as disclosed in Japanese Patent Laid-Open No. 117991 have been attempted.

However, as the blast furnace coke to be used under a circumstance in which the operation with a low fuel ratio as described above is required, a coke having characteristics that is high reactivity in a temperature region between a thermal reserve zone and a melting zone and also is hard to be degradation even after a reaction and another characteristic that is resistant to degradation in a temperature region between the melting zone to lower side of the furnace including a raceway section is required.

In relation with degradation characteristic of coke in the blast furnace, an understanding as described below has been prevailing. That is, as an index of this degradation characteristic, reactivity with $CO_2$ (CRI) and strength after reaction with $CO_2$ (CSR) are used and, particularly, CSR is regarded as important. Therefore, in blast furnace operations of Japanese iron and steel manufacturers, a management value is set on CSR and productions of coke have been conducted while maintaining a consistent CSR. However, as indicated by A line shown in FIG. 1, CRI and CSR are correlated with each other in a favorable manner; therefore, there has existed a problem that, if CSR is attempted to be maintained above a specified value, then CRI must be suppressed below another specified value. Plots in a neighborhood of the A line denote respective results of measurements of strengths after reactions on data prepared by varying a reaction time of process coke with $CO_2$ (at the time of CRI being 25%, CSR being 60.9%).

In this regard, ordinary methods such as a method of increase a blending ratio of the non- to slight-caking coal, a method of adding an inert coal material and the like surely increase reactivity of coke, but, on the other hand, decrease melting capability between coal particles to effect decrease of coke strength; hence, it can not be said that they are effective methods of solving the above-described problems.

DISCLOSURE OF THE INVENTION

An object of the present invention is to provide a blast furnace coke in which $CO_2$ reactivity is high and coke strength is large.

Another object of the present invention is to produce blast furnace coke having high reactivity and high strength at a low cost by using a coal blend composed of a small number of brands comprising a large quantity of semi-strong caking coal having medium rank and low fluidity (hereinafter referred to simply as "medium rank low fluidity coal").

That is, the present invention proposes a blast furnace coke having high reactivity and high strength, the blast furnace coke being a coke that can be obtained by a method comprising the steps of:

charging a coal blend comprising 60 wt % or more of semi-heavy caking coal having medium rank and low fluidity in which a content of a non-melting inert component is 30 vol % or more in total into a coke oven; and coking the coal blend, characterized by having a pore size distribution in which a content ratio of pores having a diameter of less than 10 $\mu$m is from 12 vol % to 15 vol % and a content ratio of pores having a diameter of from 10 $\mu$m to 100 $\mu$m is from 10 vol % to 15 vol %.

Preferably, the above-described pore size distribution is controlled such that a content ratio of pores having a diameter of less than 1 $\mu$m is 6 vol % or more and a content ratio of pores having a diameter of 100 $\mu$m or more is less than 20 vol %.

Further, the present invention is a blast furnace coke having high reactivity and high strength, the blast furnace coke being coke that can be obtained by the method comprising the steps of:

charging a coal blend comprising from 60 wt % to 95 wt % of semi-heavy caking coal having medium rank and low fluidity in which a mean reflectance (Ro) is from 0.9 to 1.1 and a maximum fluidity (MF) is 3.0 or less and the balance being a caking coal in which a mean reflectance (Ro) exceeds 1.1 into a coke oven; and coking the coal blend, characterized by having a pore size distribution in which a content ratio of pores having a diameter of less than 10 $\mu$m is from 12 vol % to 15 vol % and a content ratio of pores having a diameter of from 10 μm to 100 μm is from 10 vol % to 15 vol %.

Preferably, in the present invention, a caking coal in which a mean reflectance (Ro) is 1.3 or more and/or a semi-heavy caking coal in which a maximum fluidity (MF) is 3.0 or more is used as the balance of the above-described coal blend.

Preferably, further, the tumbler strength (wt % of +6 mm after 400 rotations; hereinafter referred to as "$TI_6$") is 83% or more.

Next, the present invention proposes a production method of a blast furnace coke having high reactivity and high strength characterized by comprising the steps of:

charging a coal blend comprising 60 wt % or more of semi-heavy caking coal having medium rank and low fluidity in which a content of a non-melting inert component is 30 vol % or more in total into a coke oven; and coking the coal blend, wherein the blast furnace coke is a coke having a pore size distribution in which a content ratio of pores having a diameter of less than 10 μm is from 12 vol % to 15 vol % and a content ratio of pores having a diameter of 10 μm to 100 μm is 10 vol % to 15 vol %.

Preferably, further in the present invention proposes a production method of a blast furnace coke having high reactivity and high strength characterized by comprising the steps of:

charging a coal blend comprising from 60 wt % to 95 wt % of semi-heavy caking coal having medium rank and low fluidity in which a mean reflectance (Ro) is from 0.9 to 1.1 and a maximum fluidity (MF) is 3.0 or less and the balance being a caking coke in which a mean reflectance (Ro) exceeds 1.1 into a coke oven; and coking the coal blend, wherein the blast furnace coke is a coke having a pore size distribution in which a content ratio of pores having a diameter of less than 10 μm is from 12 vol % to 15 vol % and a content ratio of pores having a diameter of from 10 μm to 100 μm is from 10 vol % to 15 vol %.

Preferably, further, in the present invention, a caking coal in which a mean reflectance (Ro) is 1.3 or more and/or a semi-heavy caking coal in which a maximum fluidity (MF) is 3.0 or more is used as the balance of the above-described coal blend.

Preferably, further, in the present invention, the tumbler strength $TI_6$ is 83% or more.

Preferably, furthermore, the pore size distribution is controlled such that a volumetric content ratio of pores having a diameter of less than 1 μm is 6 vol % or more and a volumetric content ratio of pores having a diameter of 100 μm or more is 20 vol % or less.

According to the present invention, different from a conventional blend composed of a large number of brands in which 10 or more brands are blended, a blend composed of a small number of brands (about 5 brands or less) in which a large quantity of coal low in cost and abundantly available is blended can be realized whereupon a coke having a higher reactivity with $CO_2$ than an ordinary one and having coke strength equal to or higher than an ordinary one can be produced in a consistent manner.

BEST MODE FOR CARRYING OUT THE INVENTION

Figure 1:
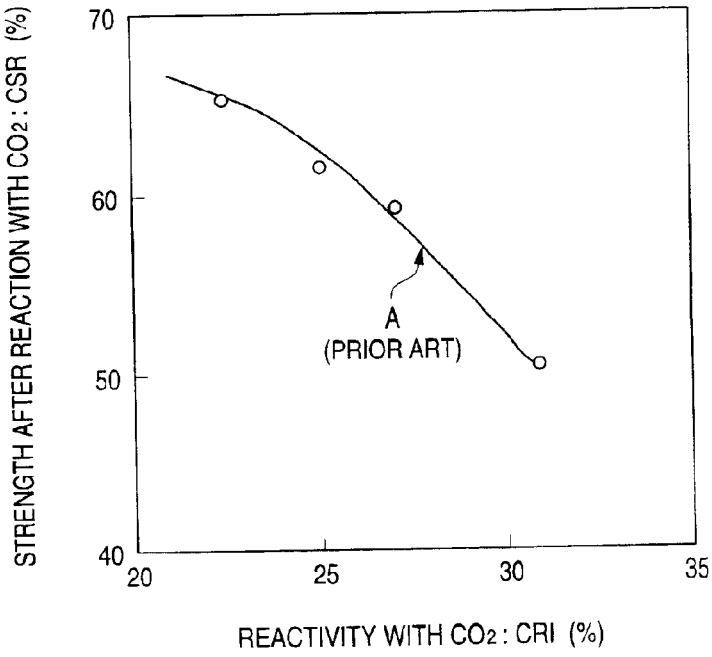
FIG. 1 is a graph showing a relation between reactivity with $CO_2$ (CRI) and strength after reaction with $CO_2$ (CSR) of a conventional process coke.

Inventors have studied, particularly, relations among pore morphologies, reactions and degradation characteristics of coke. That is, when diffusion of $CO_2$ into an inside of coke is considered, being based on an understanding that, when many fine pores are present therein, diffusion resistance of $CO_2$ is large; further, when surface areas of pores which are concerned with a gasification reaction are large, the above-described reaction with $CO_2$ is likely to center around the surface (the topochemical effect), components contained in coal, above all, an inert component which has characteristics of holding fine pores even after the coal is coked is particularly noted.

Therefore, after coke is produced from a coal blend primarily composed of a coal having a large quantity of inert component, pore forms, reactivity and degradation characteristics thereof were investigated.

As a result, following knowledge was obtained: (1) coke produced from coal primarily composed of coal having a large quantity of inert component is rich in fine pores having a diameter of less than 10 μm, particularly less than 1 μm and has a large specific surface area; (2) the coke is relatively scarce in coarse pores having a diameter of from 10 μm to 100 μm, particularly 100 μm or more which are considered to affect coke strength; (3) when a number of the fine pores described in the above (1) is large, the reaction with $CO_2$ centers in such fine pores, which prevents the fine pores from becoming coarse, effectively acts on coke strength after reaction and enhances degradation resistance; (4) through the above-described topochemical effect is generated, degradation resistance as described in (3) is generated; and other characteristics.

Based on such knowledge, inventors have tried to produce coke having high reactivity and high strength.

That is, inventors have continuously studied blending of material coals. As a result, it was found that a "congeniality" in combination of brands, that is, a synergistic effect, exists in a specified brand of coal depending on a combination between a specified brand of coal and other brands of coal such that characteristics of coke derived from a coal blend based on blending of the specified brand of coal and other brands of coal have substantially been improved compared with characteristics, that is, a weighted mean value of strength, reactivity with $CO_2$ and the like, of coke comprising a single brand derived from a coal comprising a single brand. With reference to this point, inventors have previously developed a method of estimated coke strength in which an interaction among brands has been taken into consideration (Japanese Patent Laid-Open No. 255066/1997).

It was confirmed that pore morphologies of the coke have a strong effect on this interaction and, accordingly, a coke having high reactivity and high strength is produced by making effective use of this congeniality.

Further, an observation of pore morphologies (or pore size distribution) and study of blending material coals have continuously been conducted. As a result, it was found that coke having high reactivity with $CO_2$ and high strength can be obtained, if only both content ratios of pores having a diameter of less than 10 μm and pores having a diameter of from 10 μm to 100 μm are controlled and, further, both content ratios of pores having a diameter of less than 1 μm and pores having a diameter of 100 μm or more are controlled.

To take an example, it was found that a pore size distribution as a characteristic of coke having high reactivity and high strength in which a content ratio of pores having a diameter of less than 10 μm is from 12 vol % to 15 vol %, preferably in addition thereto further a content ratio of pores having a diameter of less than 1 μm is 6 vol % or more, or a content ratio of pores having a diameter of from 10 μm to 100 μm is from 10 vol % to 15 vol %, preferably in addition thereto further a content ratio of pores having 100 μm or more is 20 vol % or less is effective. In other words, since a specific surface area of pores having a diameter of less than 1 μm occupies 95% or more of a total, the higher the content ratio thereof becomes, the higher the reactivity becomes. On the other hand, since relatively coarse pores having a diameter of 10 μm or more contribute to decrease of strength, the lower the content ratio thereof becomes, the higher the strength becomes (also after reaction).

Embodiments according to the present invention will now be described below along with steps which led to development of the present invention.

Figure 2:
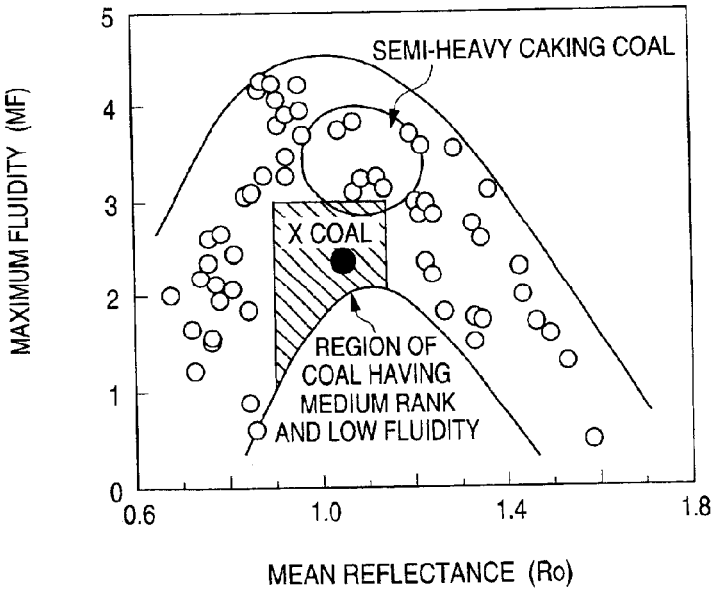
FIG. 2 is a graph showing a relation between maximum fluidity (MF) and mean reflectance (Ro) of each coal.
Figure 3A:
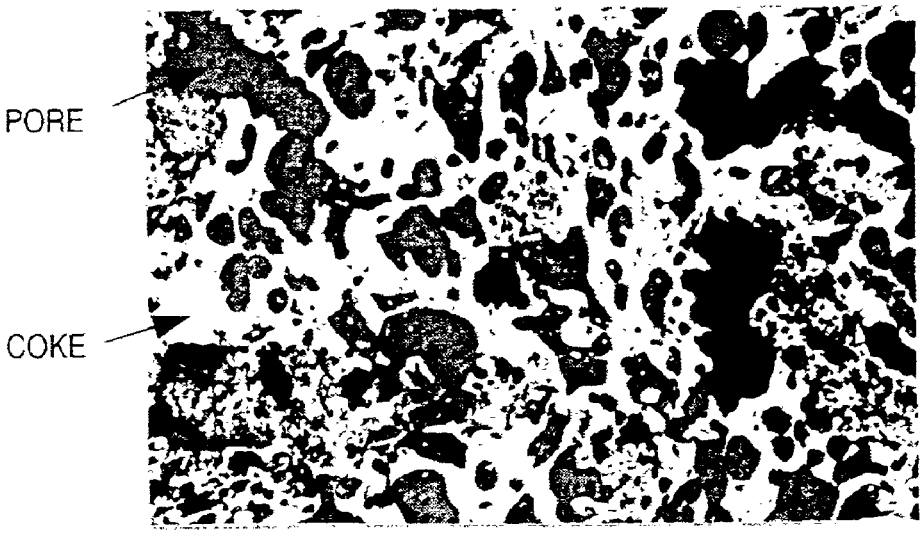
FIG. 3 is a photograph of magnification power of 50 each of a single-brand coke made of coal having medium rank and low fluidity and an ordinary coke.
Figure 3B:
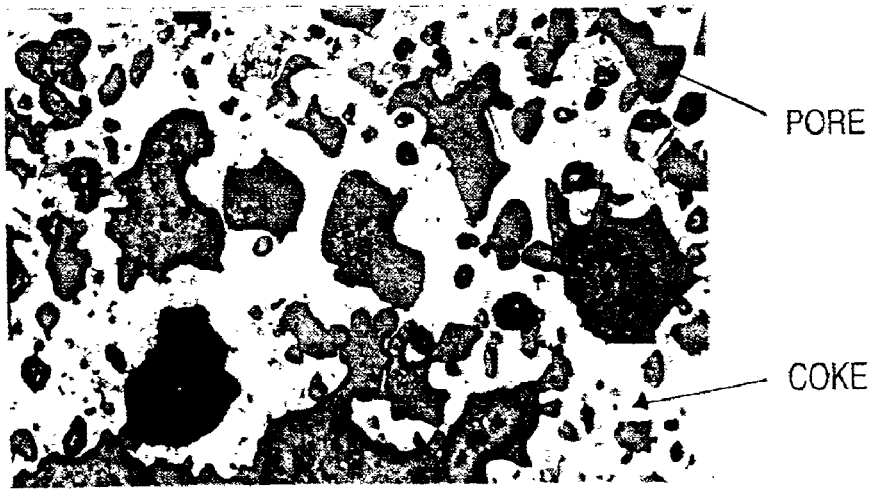

In the present invention, a coal blend having a blending ratio as high as 60% to 95% of coal having medium rank and low fluidity in which a non-melting inert content is 30% or more is carbonized in a coke oven. This coal having medium rank and low fluidity is classified as a semi-heavy caking coal petrographically. Though most of semi-heavy caking coals having a relatively high fluidity have 3.0 or more of maximum fluidity (MF) which is an indicator of caking property (encircled portion in FIG. 2), such coal having medium rank and low fluidity, as shown as shaded portion in FIG. 2, has lower maximum fluidity than the maximum fluidity and, further, a coal structure thereof, as shown in x coal and y coal described in Table 1, contains a large quantity of semi-fusinite, fusinite and the like which are inert components. Caused by this coal structure containing a large quantity of inert components, coke derived from this coal having medium rank and low fluidity is characterized by a large quantity of fine pores therein, as shown in FIG. 3.

Figure 4:
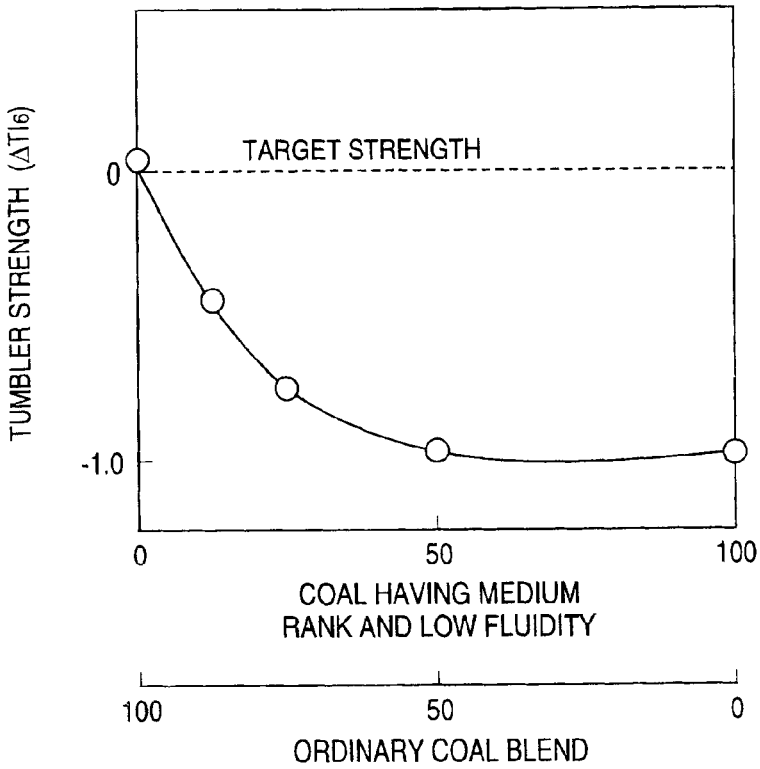
FIG. 4 is a graph showing an effect to be given to variation ($\Delta$ $TI_6$) of tumbler strength by a blend ratio between coal having medium rank and low fluidity and ordinary coal.

Quality of coal having medium rank and low fluidity which is characterized as above has mean reflectance of 0.9 to 1.1 and maximum fluidity of 3.0 or less; such quality is approximately same as that (mean reflectance being about 1.07, maximum fluidity being 2.45) of a coal blend composed of multiple brands for use in an ordinary production of cokes. Nevertheless, inventors' study has found that, when two types of coal which are of approximately same quality, namely, a coal having medium rank and low fluidity and an ordinary coal blend are mixed, coke strength has decreased, as shown in FIG. 4, though qualities of both types of coal are approximately same with each other, and that even a target coke strength can not be maintained.

Under these circumstances, inventors have further continued studies having in mind that an interaction, that is, an "congeniality" among brands of coals may be related with the above-described characteristics.

Particularly, coking tests having been conducted on coal blend prepared by blending a coal having medium rank and low fluidity (X) and several representative types of caking coals (from A to F) shown in Table 2.

Figure 5:
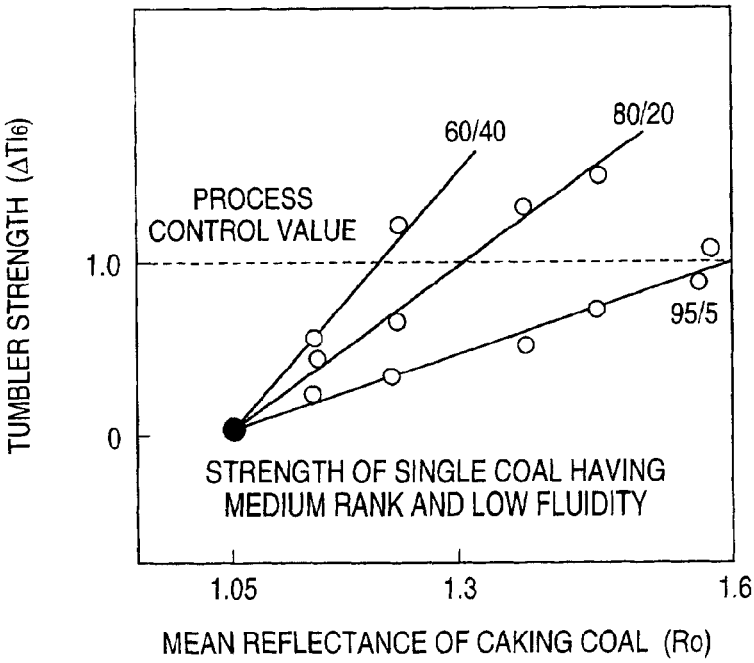
FIG. 5 is a graph showing an effect to be given to variation ($\Delta$ $TI_6$) of tumbler strength by a blend ratio between a coal having medium rank and low fluidity and a caking coal, and mean reflectance (Ro) of the caking coal.

Test results are shown in FIG. 5, where effects of blending ratios between a coal having medium rank and low fluidity and a caking coal and mean reflectance of the caking coal to strength (tumbler strength) of coke derived from respective coal blends are shown. In this regard, coke strength here means the above-described tumbler strength $TI_6$; an axis of ordinate in FIG. 5 shows improvement effects of tumbler strength of coke obtained by blending a coal having medium rank and low fluidity and caking coals (from A to F) under a condition that the coke strength of coke obtained by coking a single-brand coal having medium rank and low fluidity is set as 0. The axis of ordinate shows strength difference between a single-brand coke derived from coal having medium rank and low fluidity and a coke derived from a coal blend prepared by blending a coal having medium rank and low fluidity and a caking coal wherein the value 1.0 thereon represents an example of a process control target value. Further, numerals in FIG. 5 show blending ratios between a coal having medium rank and low fluidity and caking coals (from A to F). An axis of abscissa shows mean reflectance (Ro) of a caking coal.

Further, as is seen in FIG. 5, it is apparent that a coal having medium rank and low fluidity (X) can obtain a target coke strength ($TI_6$ being approximately 84%) which is an indicator as to whether it can be used in a blast furnace by being blended with 5 wt % to 40 wt % of each of caking coals (from A to F) thereto. When a caking coal is blended by less than 5 wt %, the strength becomes insufficient while, when the caking coal is blended by more than 40 wt %, the strength exceeds the target value; however, since a larger quantity of high-priced caking coal is used, production cost becomes higher. Furthermore, it has become clear the higher the mean reflectance of caking coal becomes, the higher the improvement effect of coke strength becomes whereupon a larger quantity of coal having medium rank and low fluidity can be used.

On this occasion, it was also clear that when a plurality of types of caking coals are used, that is, not confined to one type, same effect to the coke strength was obtained. An operation of preparing a coal blend in an actual coke production comes to be more efficient when less number of types of caking coals are used; in this regard, a number of types of caking coals may be set taking into consideration preparation operation time or inventories thereof; however, on thought of an ordinary operation, it is appropriate that a number of types of caking coals is from 1 to 3.

Ordinarily, since caking coal is an expensive type of coal, it can be said that it is desirous to suppress a blending ratio of this caking coal from a standpoint of coke production cost. Therefore, in the present invention, it is desirous to use at least one type of caking coal having mean reflectance of 1.3 or more which is highly effective in improving coke strength. In other words, this is because that use of caking coal having mean reflectance of 1.3 or more shows an improvement effect only by a blending ratio of about 5 wt % to about 20 wt %.

The above-described coal having medium rank and low fluidity is classified petrographically as semi-heavy caking coal having similar mean reflectance, since it has mean reflectance Ro of 0.9 to 1.1; however, coal having medium rank and low fluidity has a relatively large quantity of an inert component among semi-heavy caking coal or compared with heavy caking coal having higher mean reflectance so that it is characterized by low fluidity. Ordinarily, coals soften-melt at a temperature between from 350° C. to 550° C. where the above-described inert component lacks melting performance and, further, the inert component itself is of a porous structure having fine pores whereupon, even when it becomes a semi-coke at a temperature between 550° C. and 650° C. after undergone a softening-melting treatment or, further, when it becomes product coke after being carbonized up to 1000° C., it not only holds the porous structure having fine pores but also permits a melting component to form fine pores and hold them. That is, a large quantity of fine pores are formed in the coke obtained by carbonizing the coal having a large quantity of inert component.

Next, measurement results of pore size distributions of a single-brand coke which can be obtained by coking only a coal having medium rank and low fluidity, a coke blend which can be obtained by a coking coal blend comprising a coal having medium rank and low fluidity and a caking coal, and an ordinary coke which can be obtained by coking a coal blend according to a blend composed of multiple brands are shown in Table 3. As is seen in Table 3, fine pores of less than 10 $\mu$m occupies a large share in the a single-brand coke obtained from only a coal having medium rank and low fluidity; to contrast, a number of fine pores in a coke blend derived from a blend of coal having medium rank and low fluidity and a caking coal is a little less than the above but is larger than that of the ordinary coke. Further, in this case, a volume percent of relatively coarse pores of from 10 $\mu$m to 100 $\mu$m is smaller than that of the ordinary coke.

Next, steps as to how coke having high reactivity and high strength are prepared is described.

With reference to coke having high reactivity and high strength, there are many types of evaluation methods; in the present invention, 200 g of coke having a particle size of 20 mm±1 mm are reacted up to 25 wt % thereof at 1100° C. under a $CO_2$ flow with a flow rate of 5 l/min and the resultant reaction product is evaluated in terms of I-typed drum strength (percent by weight of +10 mm after 600 rotations) $I_{RI=25\%}$ whereupon coke in a relation of $I_{RI=25\%} \geqq 65$ is designated as coke having high reactivity and high strength.

As already described above, according to the present invention, different from a conventional coal blend composed of multiple brands comprising more than 10 brands of coals, even when a coal blend composed of a small number of brands (about 5 brands or less) blended with a large quantity of low-priced coal which is abundantly available is used, coke having reactivity with $CO_2$ higher than conventional coke and coke strength equal to or higher than the conventional one can be produced in a consistent manner.

In other words, the present invention can achieve the following:

(1) A coal blend comprising 60 wt % or more of coal having medium rank and low fluidity in which a content ratio of inert component is 30 wt % or more in total is carbonized as a coke oven charge coal; further preferably;

(2) a coal blend using a caking coal having 1.3 or more of mean reflectance (Ro) and/or a semi-heavy caking coal having 3.0 or more of maximum fluidity (MF) as the balance of the coal blend described in the above (1) is carbonized as a coke oven charge coal; or (3) A coal blend comprising 60 wt % or more of coal having medium rank and low fluidity in which mean reflectance (Ro) is from 0.9 to 1.1 and maximum fluidity (MF) is 3.0 or less is carbonized as a coke oven charge coal; further preferably (4) A coal blend using a caking coal having 1.3 or more of mean reflectance (Ro) and/or a semi-heavy caking coal having 3.0 or more of maximum fluidity (MF) as the balance of coal blend described in the above (3) is carbonized as a coke oven charge coal.

Now, embodiments will be described below.

(1) Quality evaluation was conducted on a coke obtained from a coal blend comprising coal shown in Table 2.

A coke oven charge coal blend was prepared by using X coal as the above-described coal having medium rank and low fluidity which is a main component thereof, A coal as an example of coal having high carbonization for a purpose of reinforcement of strength, C coal as an example of a semi-heavy caking coal which exhibits mean reflectance equal to or higher than that of a semi-heavy caking coke having medium rank and low fluidity or a heavy caking coal at a blending ratio as shown in an expression of X coal:A coal:C coal=81:9:10.

Strength after reaction $I_{RI=25\%}$ at the time of reaction rate of 25% and coke strength $TI_6$ of coke derived from the above-described coal blend, namely, based on coal comprising a large quantity of coal having medium rank and low fluidity (hereinafter referred to simply as "coke of medium rank coal") were compared with those of an ordinary coke derived from the ordinary coal blend thereby showing results in Table 4. It became apparent that, though the coke of medium rank coal has coke strength $TI_6$ similar to that of the ordinary coke, it has an enhanced $I_{RI=25\%}$ compared with the ordinary coke. That is, it became clear that it is a coke having high reactivity and high strength.

It is preferable to use, for example, Black water (BWR) coal produced in Australia as a coal having medium rank and low fluidity when such coke having high reactivity and high strength is produced.

(2) Next, a pore structure of coke having high reactivity and high strength will be described.

Cokes were prepared such that fine pores (diameters thereof being less than 10 $\mu$m and less than 1 $\mu$m, respectively) and coarse pores (diameters thereof being from 10 $\mu$m to 100 $\mu$m and 100 $\mu$m or more, respectively) were varied in vol % and then respective pore size distributions were measured. Further, reactivity CRI, strength after reaction CSR, I-type drum strength (weight % of +10 mm after 600 rotations) at various reaction rates were measured to calculate $I_{RI=25\%}$ by means of a linear approximation techniques. Furthermore, tumbler strength $TI_6$ thereof were measured. Results of these measurements are shown in Table 5.

As shown in Table 5, when volume of pores having a diameter of less than 10 $\mu$m was from 12 vol % to 15 vol % and volume of pores having a diameter of from 10 $\mu$m to 100 $\mu$m was from 10 vol % to 15 vol % (Examples 1 to 7), $I_{RI=25\%}$ value was 65.0 or more and cold strength value $TI_6$ was comparable to that of an ordinary coke (process coke). On the other hand, when volume of pores having a diameter of less than 10 $\mu$m was not from 12 vol % to 15 vol % and volume of pores having a diameter of from 10 $\mu$m to 100 $\mu$m was not from 10 vol % to 15 vol % (Comparative Examples 1 to 3), $I_{RI=25\%}$ did not attain 65.0 or more.

Figure 6:
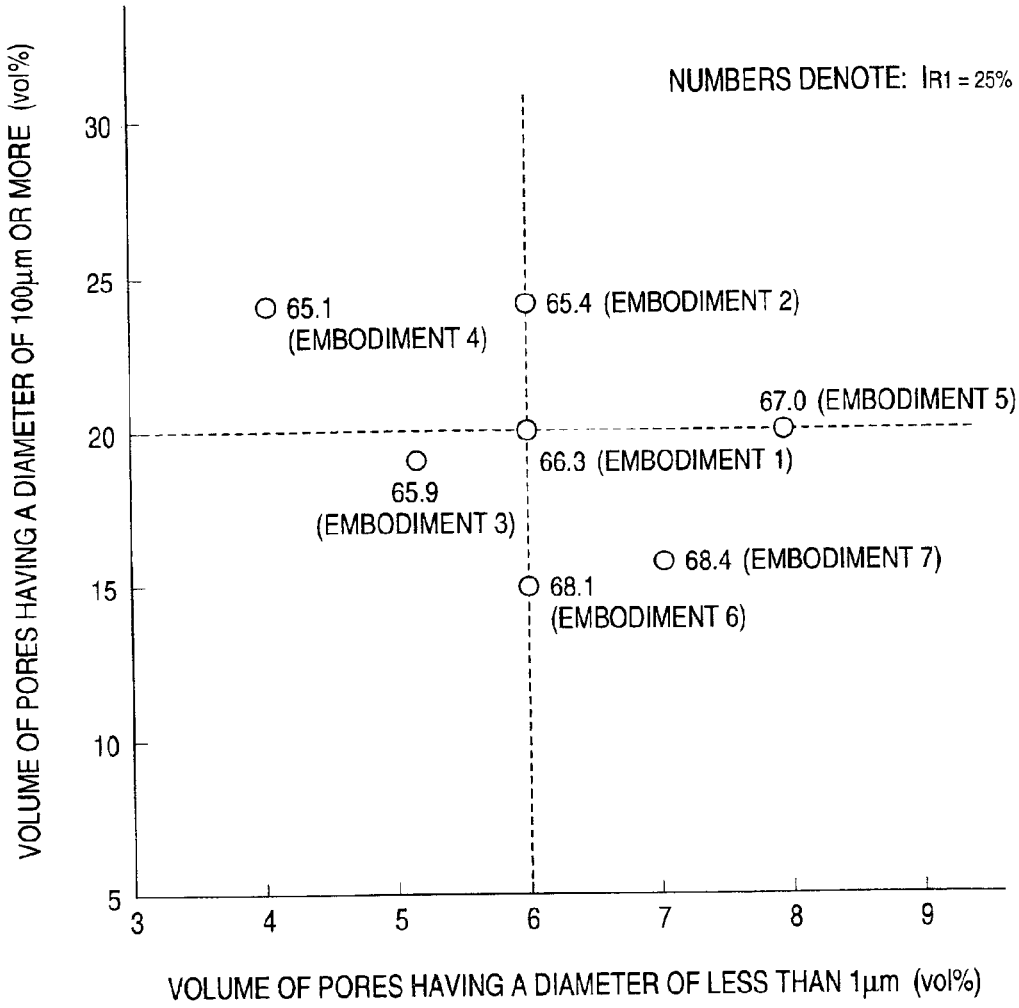
FIG. 6 is a graph showing an effect to be given to $I_{RI=25\%}$ by a relation between volume of pores having a diameter of less than 1 μm and volume of pores having a diameter of 100 μm or more.

Further, it was found that, as shown in FIG. 6, even among Examples 1 to 7, when volume of finer pores having a diameter of less than 1 μm was 6 vol % or more and volume of coarse pores having a diameter of 100 μm or more was 20 vol % or less (Examples 5 to 7), $I_{RI=25\%}$ was 66.0 or more and both reactivity and strength were high thereby effecting a coke which is hard to be pulverized. Furthermore, when volume of pores having a diameter of from 10 μm to 100 μm exceeded 15 vol %, and further, volume of pores having a diameter of 100 μm or more exceeded 20 vol % (Comparative Examples 1 and 2), $TI_6$ became lower.

From the above finding, it was found that a coke having high reactivity and high strength of $I_{RI=25\%}$ can be defined by a content ratio of fine pores having a diameter of less than 10 μm and a content ratio of coarse pores having a diameter of from 10 μm to 100 μm. Further, coke having higher reactivity and high strength can be defined by restricting a volumetric content ratio of pores having a diameter of less than 1 μm with reference to fine pores and a volumetric content ratio of pores having a diameter of 100 μm or more with reference to coarse pores. Accordingly, it was found that a blast furnace coke can be produced in an assured manner by controlling coke strength after reaction with $CO_2$ by means of a volumetric content ratio of fine pores having a diameter of less than 10 μm, preferably less than 1 μm and a volumetric content ratio of coarse pores having a diameter of from 10 μm to 100 μm and, further, that of coarse pores having a diameter of 100 μm or more.

Further, it was found that, as characteristics of a coke having high reactivity and high strength, there is a pore size distribution in which a content ratio of pores having a diameter of less than 10 μm is from 12 vol % to 15 vol %, preferably that of pores having a diameter of less than 1 μm is 6 vol % or more, a content ratio of pores having a diameter of from 10 μm to 100 μm is from 10 vol % to 15 vol % and, further, in addition thereto, a content ratio of pores having a diameter of 100 μm or more is 20 vol % or less.

Production results of a blast furnace coke having high reactivity and high strength produced by employing a coal having medium rank and low fluidity will now be explained.

As is apparent from Examples 8 to 15 shown in Table 6, when a blending ratio of a coal having medium rank and low fluidity in which a quantity of inert component is 30 vol % or more was 60 mol % or more, cold strength $TI_6$ was 83.4 or more and strength after reaction $I_{RI=25\%}$ at a constant reaction rate of 25% was 65.0 or more whereupon such coal turned into a coke having high reactivity and high strength. Further, as shown in Examples 16 to 21, a coal comprising 60 wt % to 95 wt % of coal having medium rank and low fluidity in which mean reflectance (Ro) is from 0.9 to 1.1 and maximum fluidity (MF) is 3.0 or less and the balance being coal having mean reflectance (Ro) exceeding 1.1 turned also into coke having high reactivity and high strength in which $TI_6$ was 83.7 or more and $I_{RI=25\%}$ was 65.0 or more.

On the other hand, even when a content ratio of inert component was 30 vol % or more, if the blending ratio thereof was less than 60 wt % (Comparative Example 5), though cold strength $TI_6$ was more than that of a process coke (Comparative Example 4), $I_{RI=25\%}$ was 65.0 or less. Further, when a content ratio of inert component was less than 30 vol % (Comparative Examples 6 and 13), mean reflectance (Ro) was less than 0.9 (Comparative Example 7) or maximum fluidity (MF) exceeded 3.0 (Comparative Example 8) in a coal, $I_{RI=25\%}$ was not 65.0 or more. Further, even when a blending ratio of coal having medium rank and low fluidity in which Ro was from 0.9 to 1.1 and MF was 3.0 or less was less than 60 wt % (Comparative Examples 9 and 10), $I_{RI=25\%}$ was a little larger than that of the process coke, but was not 65.0 or more. Further, when a blending ratio of coal having medium rank and low fluidity in which Ro was from 0.9 to 1.1 and MF was 3.0 or more was from 60 to 95 wt % and the balance of the coal had Ro of 1.1 or less (Comparative Examples 11 and 12), $I_{RI=25\%}$ was 65.0 or less.

As is apparent from the above description, it was found that a coke having high reactivity and high strength can be obtained by blending 60 wt % or more of a coal having medium rank and low fluidity in which a content ratio of inert component is 30 wt % or more or mean reflectance (Ro) is from 0.9 to 1.1, and maximum fluidity is 3.0 or less and the balance being a caking coal in which mean reflectance (Ro) is 1.3 or more and/or a semi-caking coal in which maximum fluidity (MF) is 3.0 or more.

Figure 7:
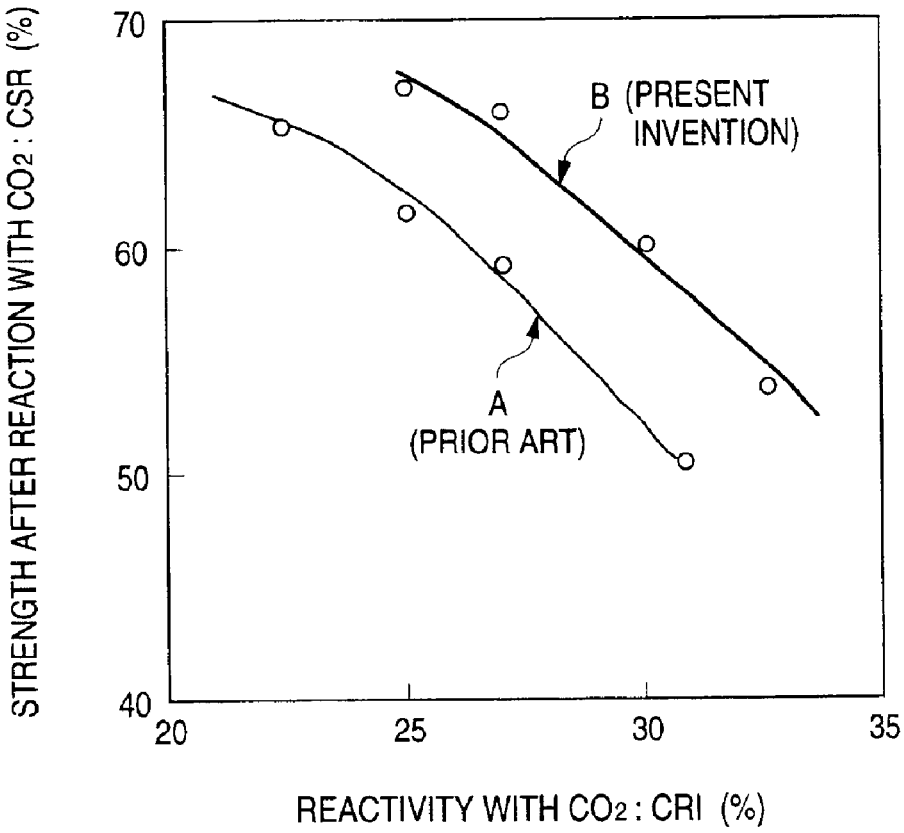
FIG. 7 is a graph showing a relation between reactivity with $CO_2$ (CRI) and strength after reaction with $CO_2$ (CSR) of the coke according to the present invention.

An improvement effect of strength after reaction with $CO_2$ of the coke according to the present invention was investigated by varying a reaction rate and the thus investigated result is now explained. As is shown in FIG. 7, against ordinary A line (process coke), B line according to the present invention is a result (CSR=67% at the time of CRI=25%) of investigation on respective strengths after reaction of samples having different reaction rates prepared by changing reaction times of the coke in Examples 5; it is known that it is positioned above the ordinary line thereby permitting it to be a coke having high reactivity and high strength.

INDUSTRIAL APPLICABILITY

In a production of an ordinary blast furnace coke, a method of blending a multiplicity of brands where a coal blend is prepared by blending 10 or more brands of coals has been executed. By adopting the present invention, a coal having medium rank and low fluidity which has not easily been utilized in the method of blending a multiplicity of brands can affluently be used. Particularly, by controlling pore morphologies of fine pores which are originated in an inert component by means of blending an appropriate caking coal, a coke which can hold high coke strength even when reactivity with $CO_2$ is enhanced can be produced. As a result, (1) reduction of production cost of a blast furnace coke;

(2) reduction of fuel cost of a blast furnace by enhancing reactivity with CO2 of coke;

(3) reduction of emission of $CO_2$ by lowering a ratio of being fired; and the like are effects among others which can provide a great merit not only to iron manufacturing industry but also to environmental protection.

TABLE 1

| | Coal Properties | | | | Coal macerals analysis | | |
|---|---|---|---|---|---|---|---|
| | | | | | vitrinite | semi-fusinite | fusinite |
| | ASH | VM | MF | Ro | (Vt) | (SF) | (F) |
| A coal | 7.9 | 29.5 | 4.17 | 1.12 | 70.2 | 9.5 | 3.6 |
| B coal | 8.7 | 20.4 | 2.63 | 1.49 | 82.7 | 5.2 | 7.5 |
| C coal | 9.1 | 28.3 | 3.91 | 1.12 | 78.2 | 8.6 | 4.7 |
| D coal | 8.9 | 18.6 | 1.72 | 1.60 | 80.1 | 8.9 | 1.9 |
| E coal | 9.3 | 24.2 | 2.08 | 1.19 | 78.0 | 5.5 | 10.6 |
| F coal | 8.6 | 35.7 | 2.45 | 0.83 | 65.3 | 17.0 | 3.9 |
| X coal | 7.6 | 28.2 | 2.40 | 1.05 | 51.0 | 46.0 | 1.5 |
| Y coal | 7.3 | 29.1 | 2.78 | 1.04 | 56.0 | 33.6 | 5.2 |

TABLE 2

| | Mean reflectance Ro | Maximum Fluidity MF | Tumbler strength*) $\Delta TI_6$ (%) |
|---|---|---|---|
| Coal having medium rank and low fluidity - X | 1.05 | 2.40 | — |
| A | 1.59 | 1.63 | 1.1 |
| B | 1.57 | 1.42 | 0.9 |
| C | 1.46 | 2.37 | 0.7 |
| D | 1.38 | 1.22 | 0.5 |
| E | 1.23 | 1.60 | 0.3 |
| F | 1.14 | 4.08 | 0.2 |

*)$\Delta TI_6$: Improved quantity of tumbler strength of a single-brand coke derived from a single-brand X coal at a blending ration of X coal/i coal (i = A to F) being 95/5.

TABLE 3

| | | Content ratio of pores having a diameter of less than 10 $\mu$m (vol %) | Content ratio of pores having a diameter of 10 $\mu$m to 100 $\mu$m (vol %) |
|---|---|---|---|
| Present method | Single-brand coke derived from coal having medium rank and low fluidity | 15 | 14 |
| | Coke blend derived from coal having medium rank and low fluidity | 13 | 11 |
| Comparative Example | Comparative Example: Ordinary coke | 10 | 17 |

TABLE 4

| | $I_{RI-25\%}$ | $TI_6$ |
|---|---|---|
| Ordinary coke | 62.4 | 84.4 |
| Coke derived from coal having medium rank and low fluidity | 66.3 | 84.5 |

TABLE 5

| | Ratios of pores in respective pore size distributions (vol %) | | | | | |
|---|---|---|---|---|---|---|
| | less than 10 $\mu$m | less than 1 $\mu$m | 10 $\mu$m to 100 $\mu$m | more than 100 $\mu$m | $I_{RI-25\%}$ | Strength $TI_6$ |
| Example 1 | 13 | 6 | 12 | 20 | 66.3 | 84.4 |
| Example 2 | 13 | 6 | 11 | 24 | 65.4 | 84.3 |
| Example 3 | 12 | 5 | 11 | 19 | 65.9 | 84.5 |
| Example 4 | 12 | 4 | 12 | 24 | 65.1 | 84.3 |
| Example 5 | 15 | 8 | 15 | 20 | 67.0 | 84.3 |
| Example 6 | 12 | 6 | 10 | 15 | 68.1 | 84.6 |
| Example 7 | 13 | 7 | 15 | 15 | 68.4 | 84.9 |
| Comparative Example 1 | 12 | 6 | 16 | 24 | 63.2 | 84.1 |
| Comparative Example 2 | 9 | 4 | 15 | 24 | 62.4 | 84.0 |
| Comparative Example 3: Process coke | 10 | 4 | 17 | 20 | 60.9 | 84.4 |

TABLE 6

| | Coalhaving medium rank and low fluidity | | | | Coal of the balance | | | | Strength |
|---|---|---|---|---|---|---|---|---|---|
| | Ratio | Ro | MF | TI | Ratio | Ro | MF | $I_{RI-25\%}$ | $TI_6$ |
| Example 8 | 60 | 1.15 | 2.65 | 30 | 40 | 1.22 | 2.91 | 65.0 | 84.7 |
| Example 9 | 60 | 1.15 | 2.65 | 30 | 40 | 1.30 | 2.87 | 65.2 | 84.8 |
| Example 10 | 60 | 1.15 | 2.65 | 30 | 40 | 1.11 | 3.07 | 65.1 | 84.6 |
| Example 11 | 80 | 1.15 | 2.65 | 30 | 20 | 1.22 | 2.91 | 65.7 | 84.2 |
| Example 12 | 80 | 1.15 | 2.65 | 30 | 20 | 1.30 | 2.87 | 66.1 | 84.5 |
| Example 13 | 80 | 1.15 | 2.65 | 30 | 20 | 1.11 | 3.07 | 65.8 | 84.1 |
| Example 14 | 100 | 1.15 | 2.65 | 30 | — | — | — | 66.8 | 83.5 |
| Example 15 | 100 | 1.12 | 2.40 | 33 | — | — | — | 68.9 | 83.4 |
| Example 16 | 60 | 1.04 | 2.78 | 28 | 40 | 1.30 | 2.87 | 68.1 | 84.8 |
| Example 17 | 60 | 1.04 | 2.78 | 28 | 40 | 1.11 | 3.07 | 65.0 | 84.5 |
| Example 18 | 80 | 1.04 | 2.78 | 28 | 20 | 1.30 | 2.87 | 67.7 | 84.4 |
| Example 19 | 80 | 1.04 | 2.78 | 28 | 20 | 1.11 | 3.07 | 65.8 | 84.2 |
| Example 20 | 95 | 1.04 | 2.78 | 28 | 5 | 1.30 | 2.87 | 67.3 | 83.9 |
| Example 21 | 95 | 1.04 | 2.78 | 28 | 5 | 1.11 | 3.07 | 67.0 | 83.7 |
| Comparative Example 4: Process coke | — | — | — | — | — | — | — | 62.4 | 84.4 |
| Comparative Example 5 | 55 | 1.15 | 2.65 | 30 | 45 | 1.30 | 2.87 | 64.8 | 84.9 |
| Comparative Example 6 | 100 | 1.05 | 2.75 | 20 | — | — | — | 63.1 | 83.5 |
| Comparative Example 7 | 100 | 0.85 | 2.20 | 25 | — | — | — | 59.8 | 81.9 |
| Comparative Example 8 | 100 | 1.02 | 3.21 | 25 | — | — | — | 63.2 | 83.4 |
| Comparative Example 9 | 55 | 1.05 | 2.75 | 20 | 45 | 1.30 | 2.87 | 62.9 | 84.9 |

TABLE 6-continued

| | Coalhaving medium rank and low fluidity | | | | Coal of the balance | | | | Strength |
|---|---|---|---|---|---|---|---|---|---|
| | Ratio | Ro | MF | TI | Ratio | Ro | MF | $I_{RI=25\%}$ | $TI_6$ |
| Comparative Example 10 | 55 | 1.05 | 2.75 | 20 | 45 | 1.11 | 3.07 | 63.4 | 84.5 |
| Comparative Example 11 | 60 | 1.05 | 2.75 | 20 | 40 | 1.08 | 2.71 | 63.8 | 84.2 |
| Comparative Example 12 | 95 | 1.04 | 2.78 | 28 | 5 | 1.08 | 2.71 | 60.9 | 83.5 |
| Comparative Example 13 | 100 | 1.04 | 2.78 | 28 | — | — | — | 60.5 | 83.3 |

What is claimed is:

1. A blast furnace coke having high reactivity and high strength produced by a method comprising:

charging a coal blend comprising 60 wt % or more of semi-heavy caking coal having medium rank and low fluidity in which a content of a non-melting inert component is 30 vol % or more in total into a coke oven; and coking the coal blend such that the coke has a pore size distribution in which a content ratio of pores having a diameter of less than 10 μm is from 12 vol % to 15 vol % and a content ratio of pores having a diameter of from 10 μm to 100 μm is from 10 vol % to 15 vol %.

2. A blast furnace coke having high reactivity and high strength produced by a method comprising:

charging a coal blend comprising from 60 wt % to 95 wt % of semi-heavy caking coal having medium rank and low fluidity in which a mean reflectance (Ro) is from 0.9 to 1.1 and a maximum fluidity (MF) is 3.0 or less and the balance being a caking coal in which a mean reflectance (Ro) exceeds 1.1 into a coke oven; and coking the coal blend such that the coke has a pore size distribution in which a content ratio of pores having a diameter of less than 10 μm is from 12 vol % to 15 vol % and a content ratio of pores having a diameter of from 10 μm to 100 μm is from 10 vol % to 15 vol %.

3. The coke as set forth in claim 1 or 2, wherein the balance of said coal blend is characterized by a caking coal in which a mean reflectance (Ro) is 1.3 or more and/or a semi-heavy caking coal in which a maximum fluidity (MF) is 3.0 or more.

4. The coke as set forth in claim 1 or 2, wherein tumbler strength $TI_6$ is characterized by being 83% or more.

5. The coke as set forth in claim 1 or 2, wherein the pore size distribution is controlled such that a content ratio of pores having a diameter of less than 1 μm is 6 vol % or more and a content ratio of pores having a diameter of 100 μm or more is 20 vol % or less.

6. A production method of a blast furnace coke having high reactivity and high strength comprising:

charging a coal blend comprising 60 wt % or more of semi-heavy caking coal having medium rank and low fluidity in which a content of a non-melting inert component is 30 vol % or more in total into a coke oven; and coking the coal blend such that the coke has a pore size distribution in which a content ratio of pores having a diameter of less than 10 μm is from 12 vol % to 15 vol % and a content ratio of pores having a diameter of 10 μm to 100 μm is 10 vol % to 15 vol %.

7. A production method of a blast furnace coke having high reactivity and high strength comprising:

charging a coal blend comprising form 60 wt % to 95 wt % of semi-heavy caking coal having medium rank and low fluidity in which a mean relfectance (Ro) is from 0.9 to 1.1 and a maximum fluidity (MF) is 3.0 or less and the balance being a caking coke in which a mean reflectance (Ro) exceeds 1.1 into a coke oven; and coking the coal blend such that the coke has a pore size distribution in which a content ratio of pores having a diameter of less than 10 μm is from 12 vol % to 15 vol % and a content ratio of pores having a diameter of from 10 μm to 100 μm is from 10 vol % to 15 vol %.

8. The production method as set forth in claim 6 or 7, characterized by using a caking coal in which a mean reflectance (Ro) is 1.3 or more and/or a semi-heavy caking coal in which a maximum fluidity (MF) is 3.0 or more as the balance of said coal blend.

9. The production method as set forth in claim 6 or 7, wherein the tumbler strength $TI_6$ is characterized by being 83% or more.

10. The production method as set forth in claim 6 or 7, wherein the pore size distribution is controlled such that a volumetric content ratio of pores having a diameter of less than 1 μm is 6 vol % or more and a volumetric content ratio of pores having a diameter of 100 μm or more is 20 vol % or less.

* * * * *